US005833396A

United States Patent [19]

Thomas

[11] Patent Number: 5,833,396

[45] Date of Patent: Nov. 10, 1998

[54] JACK-UP OFFSHORE DRILLING OR PRODUCTION OIL PLATFORM

[75] Inventor: Pierre-Armand Thomas, Puteaux, France

[73] Assignee: Technip Geoproduction, Paris La Defense Cedex, France

[21] Appl. No.: 657,299

[22] Filed: Jun. 3, 1996

[30] Foreign Application Priority Data

Jun. 2, 1995 [FR] France ..... 95 06604

[51] Int. Cl.[6] ..... E02B 17/08

[52] U.S. Cl. ..... 405/198; 405/196

[58] Field of Search ..... 405/195.1, 196, 405/198, 200, 203

[56] References Cited

U.S. PATENT DOCUMENTS

| | | | |
|---|---|---|---|
| 516,032 | 6/1894 | Symonds | 405/198 X |
| 2,996,284 | 8/1961 | Welborn | 405/198 X |
| 3,011,467 | 12/1961 | Tourneau | 405/198 X |
| 3,014,346 | 12/1961 | Small . | |
| 3,044,269 | 7/1962 | Tourneau . | |
| 3,435,621 | 4/1969 | Johnson | 405/198 |
| 3,474,749 | 10/1969 | Williamson | 405/196 X |
| 3,946,684 | 3/1976 | Sumner | 405/198 X |
| 4,880,336 | 11/1989 | Thomas et al. | 405/198 |

FOREIGN PATENT DOCUMENTS

| | | | |
|---|---|---|---|
| 2 282 021 | 3/1976 | France . | |
| 2 329 809 | 5/1977 | France . | |
| 2 643 401 | 8/1990 | France . | |
| 2095730 | 10/1982 | United Kingdom | 405/196 |
| 81/00733 | 3/1981 | WIPO | 405/198 |

*Primary Examiner*—Tamara L. Graysay
*Assistant Examiner*—Frederick L. Lagman
*Attorney, Agent, or Firm*—Wenderoth, Lind & Ponack, L.L.P.

[57] ABSTRACT

A jack-up offshore drilling or production oil platform of the type including a barge (1) mounted so that it can be moved between a position for floating and a position for production out of the water. The barge is moved along bearing legs (2) by means of drive mechanisms (10) which each include at least two opposed sets (11). Each set is formed of a motor (12) associated with at least one set of reduction gears (13) driving, via a shaft, an output pinion (15) interacting with opposed racks (16) mounted on the bearing legs (2). Each rack (16) is provided along a length of the corresponding leg (2) necessary for moving the barge (1) between the position for floating and the production position. Also provided are devices for controlling the lowering of each leg (2) as far as a bearing structure (6) or as far as a seabed (7).

14 Claims, 7 Drawing Sheets

JACK-UP OFFSHORE DRILLING OR PRODUCTION OIL PLATFORM

BACKGROUND OF THE INVENTION

The present invention relates to a jack-up offshore drilling or production platform.

Platforms of this type generally include legs which bear on the seabed and a barge mounted so that it can be moved and adjusted in terms of height along the legs. The barge in particular can support a drill rig floor and a boring tower.

The entire platform is floated out to the drilling or production site, and the legs are lowered until they come into contact with a bearing structure or with the seabed. The barge, bearing on the legs, is then lifted up above sea level to an altitude which places it out of reach of the highest waves.

The barge can therefore be moved along the legs of the platform by means of drive mechanisms housed in a structure well known to specialists by the name "jack-house".

These drive mechanisms include at least two opposed sets each formed of a motor associated with at least one set of reduction gears driving, via a shaft, an output pinion interacting with opposed racks mounted on the legs of the platform.

What is more, each leg at its lower part has a foot, for example of square or hexagonal shape, which bears directly on the seabed, or on the bearing structure.

The racks run along practically the entire length of the legs and their greater portion serves to hold these legs up until the time when the platform is installed at the drilling or production site.

While the platform is being installed, the racks serve, via the pinions, to brake the lowering of the legs until the moment when each leg touches the seabed or the bearing structure.

Then, while the barge is being lifted up above sea level, the weight of each leg is placed on the seabed or the bearing structure and the load on the pinions is reversed and gradually the weight of the barge is taken up by the racks and the pinions as the barge progressively comes out of the water.

The racks running along practically the entire length of the legs make the legs substantially heavier and increase the hydrodynamic drag of these legs as they are being lowered.

What is more, the machining of the racks and the fitting of these racks on the legs leads to lengthy and painstaking operations which increase the cost of manufacturing the legs and therefore of the platform.

Indeed, each leg is made up of vertical chords, three or four of them, joined together by a lattice of metal girders.

Each chord is made up of sections buttwelded together and each formed, on the one hand, by a rectangular plate and, on the other hand, by stiffeners in the form of half-shells which are each welded to one of the main faces of the plate.

The rectangular plates include teeth on their lateral faces. The teeth form the diametrically opposed racks intended to interact with the output pinions of the drive mechanisms.

SUMMARY OF THE INVENTION

The present invention aims to overcome the aforementioned drawbacks by creating an offshore drilling or production oil platform in which the weight and hydrodynamic drag of the legs are reduced.

The subject of the present invention is therefore a jack-up offshore drilling or production oil platform of the type comprising a barge mounted so that it can be moved between a position for floating and a position for production out of the water. The barge is moved along bearing legs by means of drive mechanisms including at least two opposed sets each formed of a motor associated with at least one set of reduction gears driving, via a shaft, an output pinion interacting with opposed racks mounted on the legs. It is possible for the legs to be moved between a raised position and a position bearing on a bearing structure or on the seabed. Each rack is provided along a length of the corresponding leg necessary for moving the barge between the position for floating and the production position. The present invention also includes means for controlling the lowering of each leg as far as the bearing structure or as far as the seabed.

According to other features of the invention:

- each leg at its lower part includes a foot forming a buoyancy element,
- each rack is arranged at the upper part of the corresponding leg,
- the means for controlling the lowering of each leg are formed of at least one chain interacting with a meshing member mounted on the driveshaft of an output pinion and a first end of which is linked to the foot of the corresponding leg, and a second end of which is linked to the barge, the length of the chain is sufficient to lower the corresponding leg as far as the bearing structure or as far as the seabed,
- the means for controlling the lowering of each leg are formed by two chains each one interacting with a meshing member mounted on the driveshaft of each output pinion of one and the same set, a first end of each chain is linked to the foot of the corresponding leg and a second end is linked to the barge, the length of each chain is sufficient to lower the corresponding leg as far as the bearing structure or as far as the seabed,
- the rate at which each chain is paid out is higher than the tangential speed developed by the pinions along the racks,
- each meshing member is formed of a sprocket wheel or of a capstan wheel,
- the first end of each chain is linked to the foot of the corresponding leg by an elastic linkage member,
- the first end of each chain is detachable from the elastic linkage member,
- the first end of each chain is connected to the barge by a line for recovering the corresponding chain.

BRIEF DESCRIPTION OF THE DRAWINGS

The present invention will be better understood with the aid of the description which will follow given merely by way of example and made with reference to the attached drawings, in which.

DETAILED DESCRIPTION OF THE INVENTION

Figure 1:
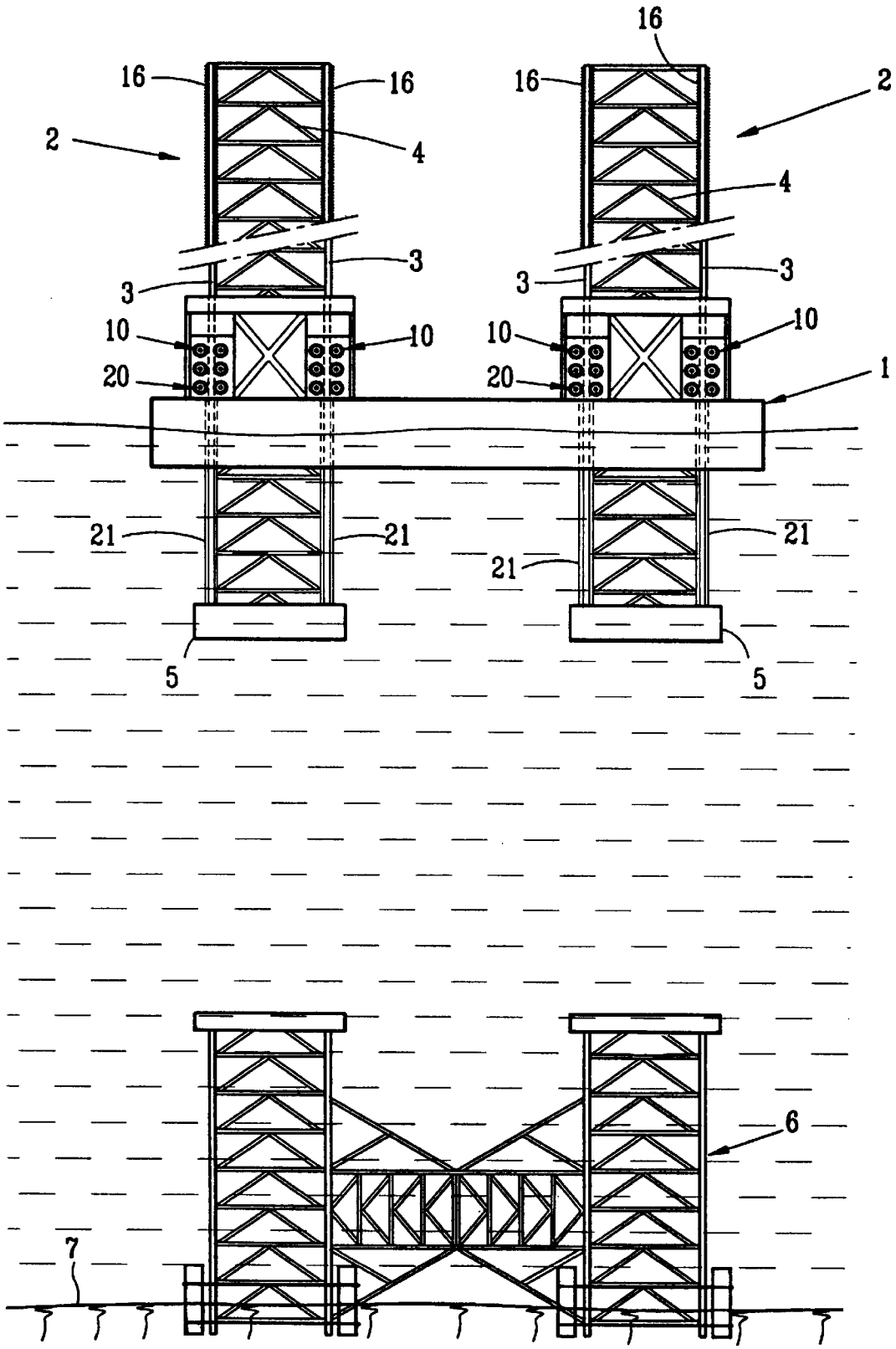
- FIG. 1 is a diagrammatic elevation of a jack-up platform according to a invention, in the configuration of lowering the legs.
Figure 2:
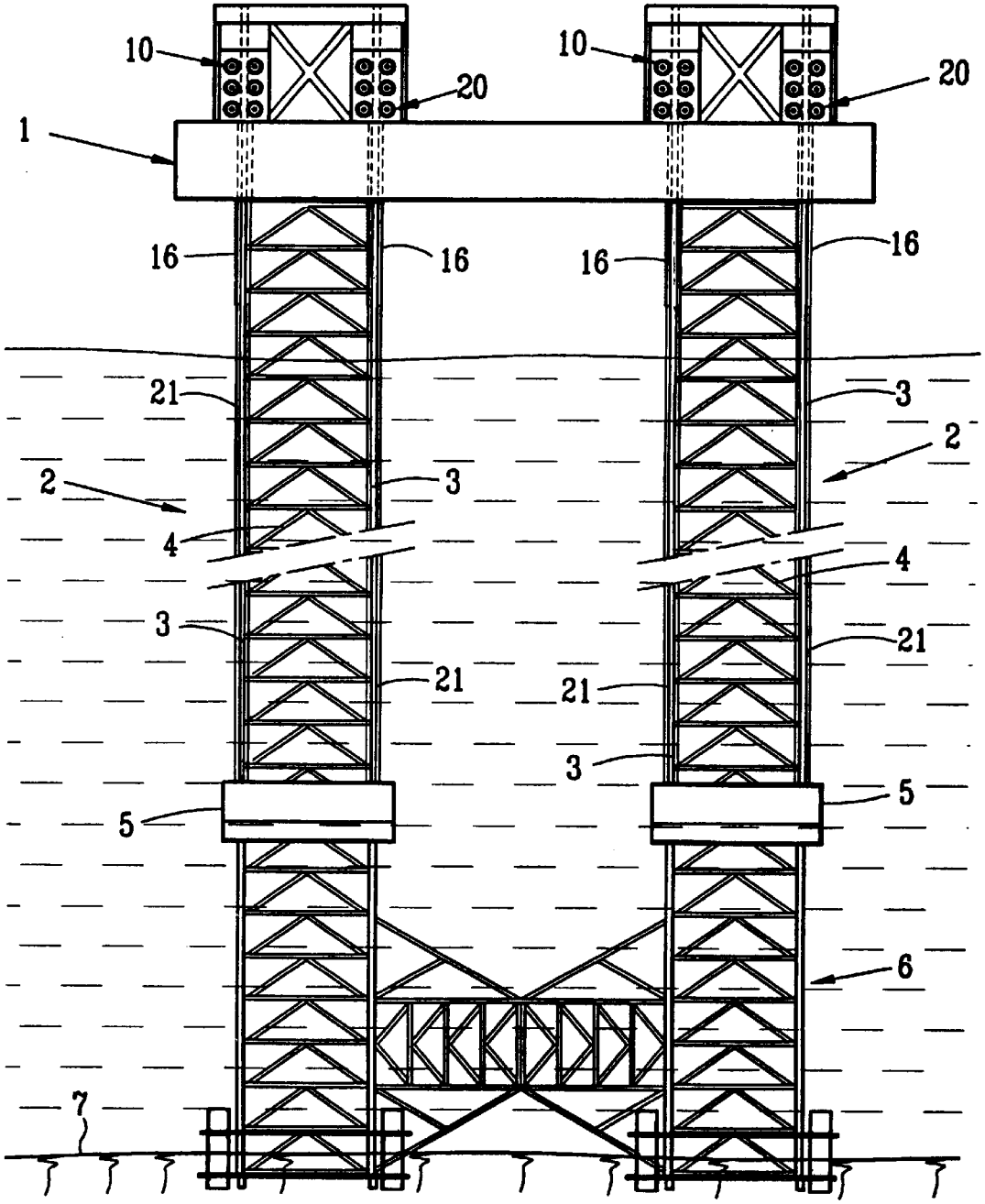
- FIG. 2 is a diagrammatic elevation of a jack-up platform according to a invention in the production configuration.
Figure 3:
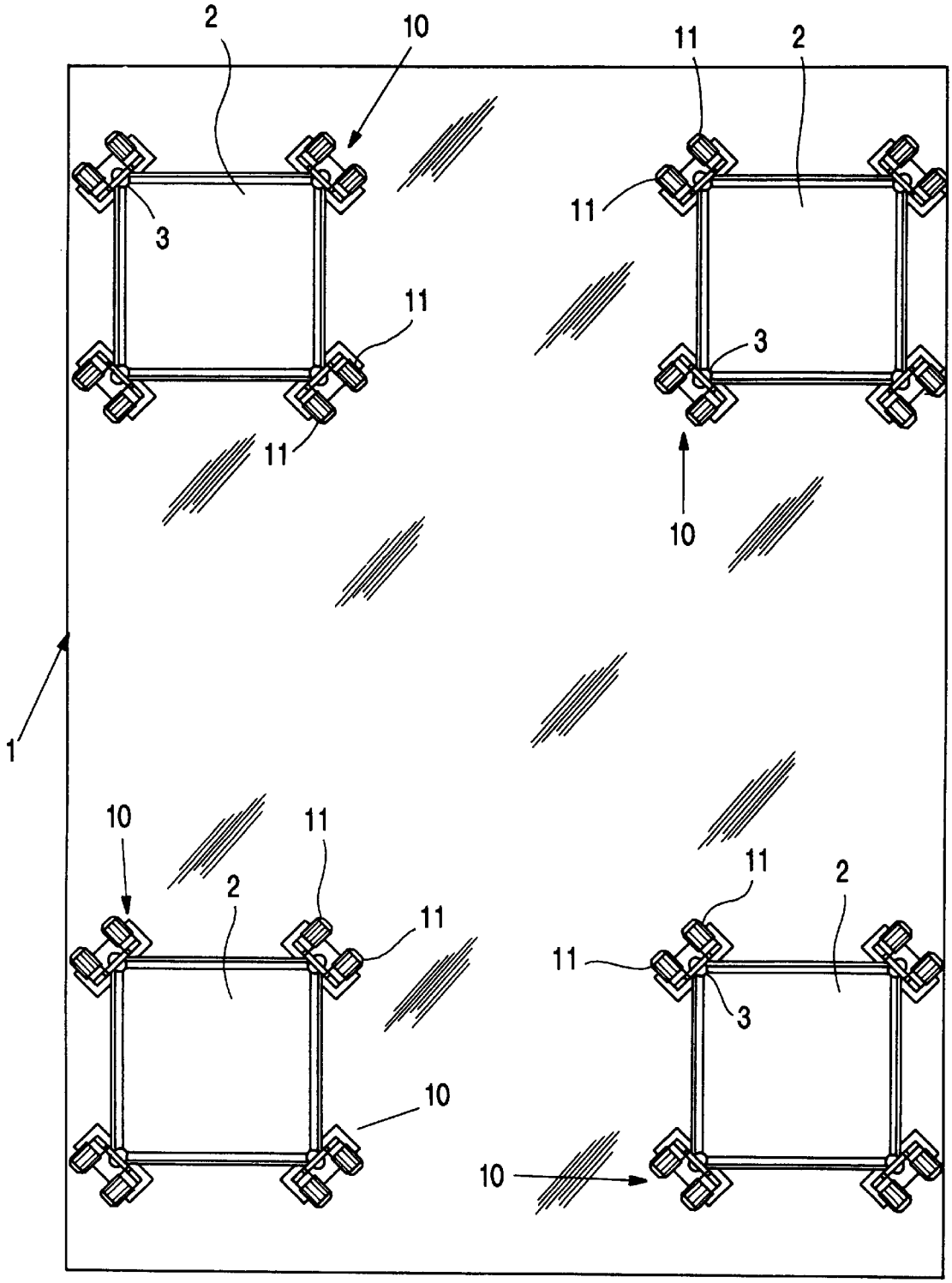
- FIG. 3 is a plan view of the platform according to the invention.

FIGS. 1 to 3 diagrammatically represent an offshore jack-up drilling or production oil platform comprising a barge 1 mounted so that it can be moved and its position adjusted on vertical legs 2.

Each of the vertical legs 2 in this particular case has a square cross-section, and consists of four chords 3 joined together by a lattice 4 of metal tubes.

The vertical legs 2 may just as easily have a triangular or circular cross-section.

Each vertical leg 2 ends at its lower part in a foot 5 which, in this example, is of square shape, but may be of hexagonal shape.

In the conventional manner, the barge 1 is also provided with the usual production equipment and living quarters as well as with a boring tower not shown.

As represented in FIG. 1, the platform is floated out to the site, that is to say that the barge 1 floats on the water and the legs 2 are, for the most part, out of the water.

Once the platform is in position at the site, first of all the legs 2 are lowered so that feet 5 bear on a bearing structure 6 placed on the seabed 7 or bear directly on the seabed 7 and, secondly, the barge 1 is lifted up above sea level to an altitude which places it out of the reach of the highest waves, as represented in FIG. 2.

The legs 2 are moved between the raised position and the position of bearing on the bearing structure 6 or on the seabed 7 by means for controlling the lowering of each leg 2. The barge 1 is moved between the position for floating and the position for production out of the water by drive mechanisms.

As represented in FIG. 3, the drive mechanisms 10 are provided at each of the chords 3 of the vertical legs 2 and are housed in a structure well known to specialists by the name "jack-house".

Figure 4:
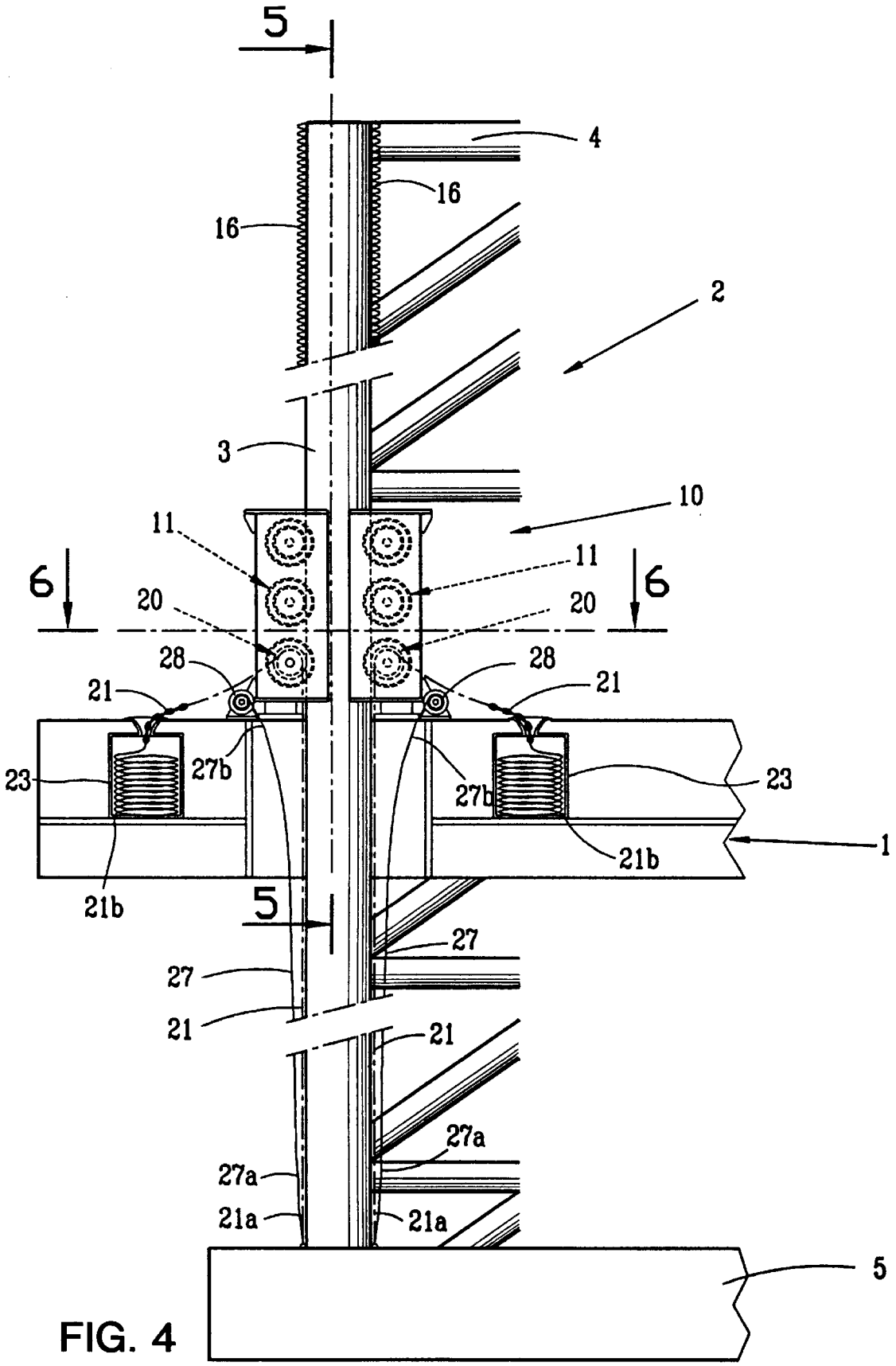
- FIG. 4 is a diagrammatic view on a larger scale of a chord of a leg of the platform according to the invention.
Figure 5:
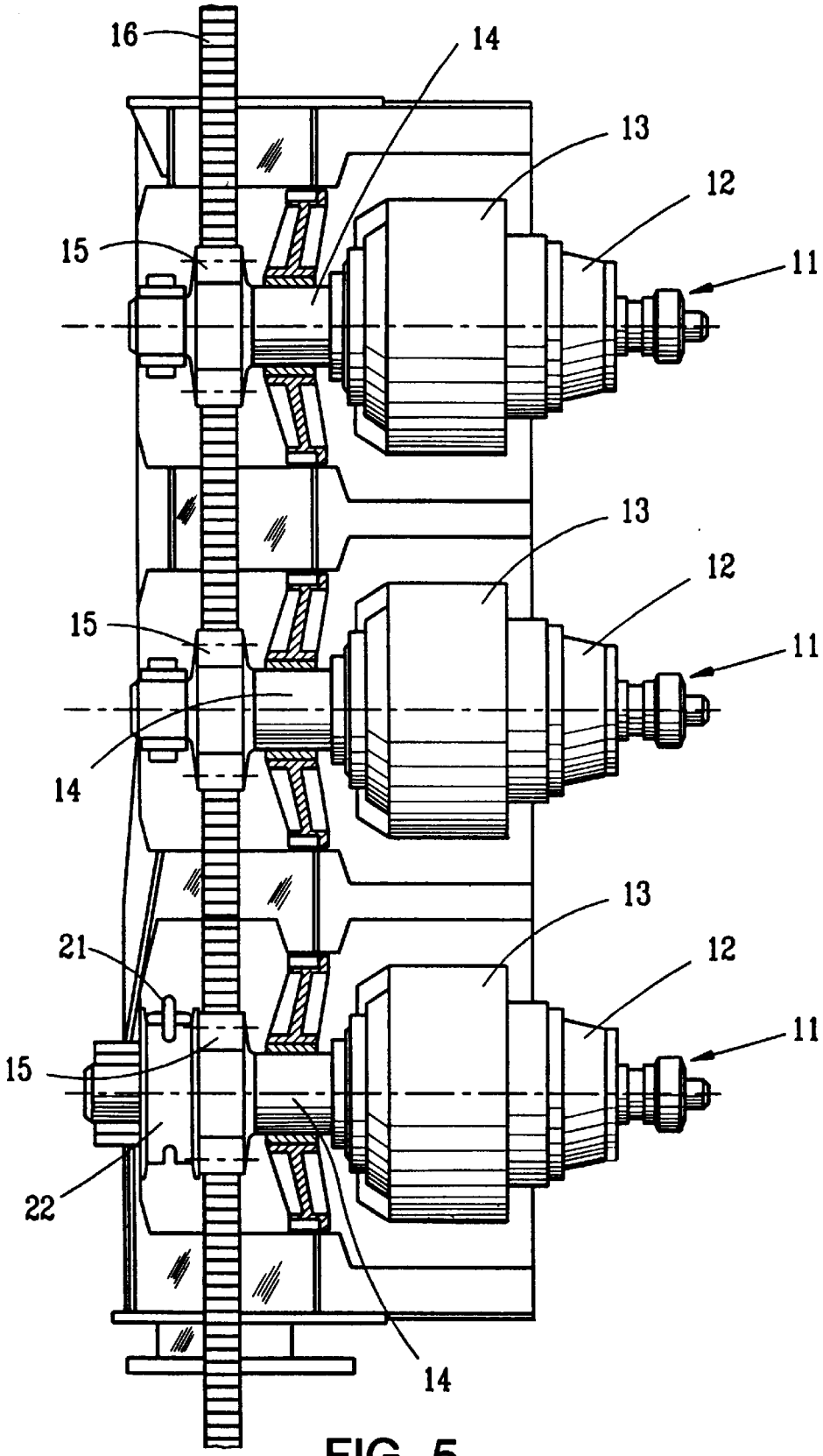
- FIG. 5 is a sectional view taken along line 5—5 of FIG. 4.
Figure 6:
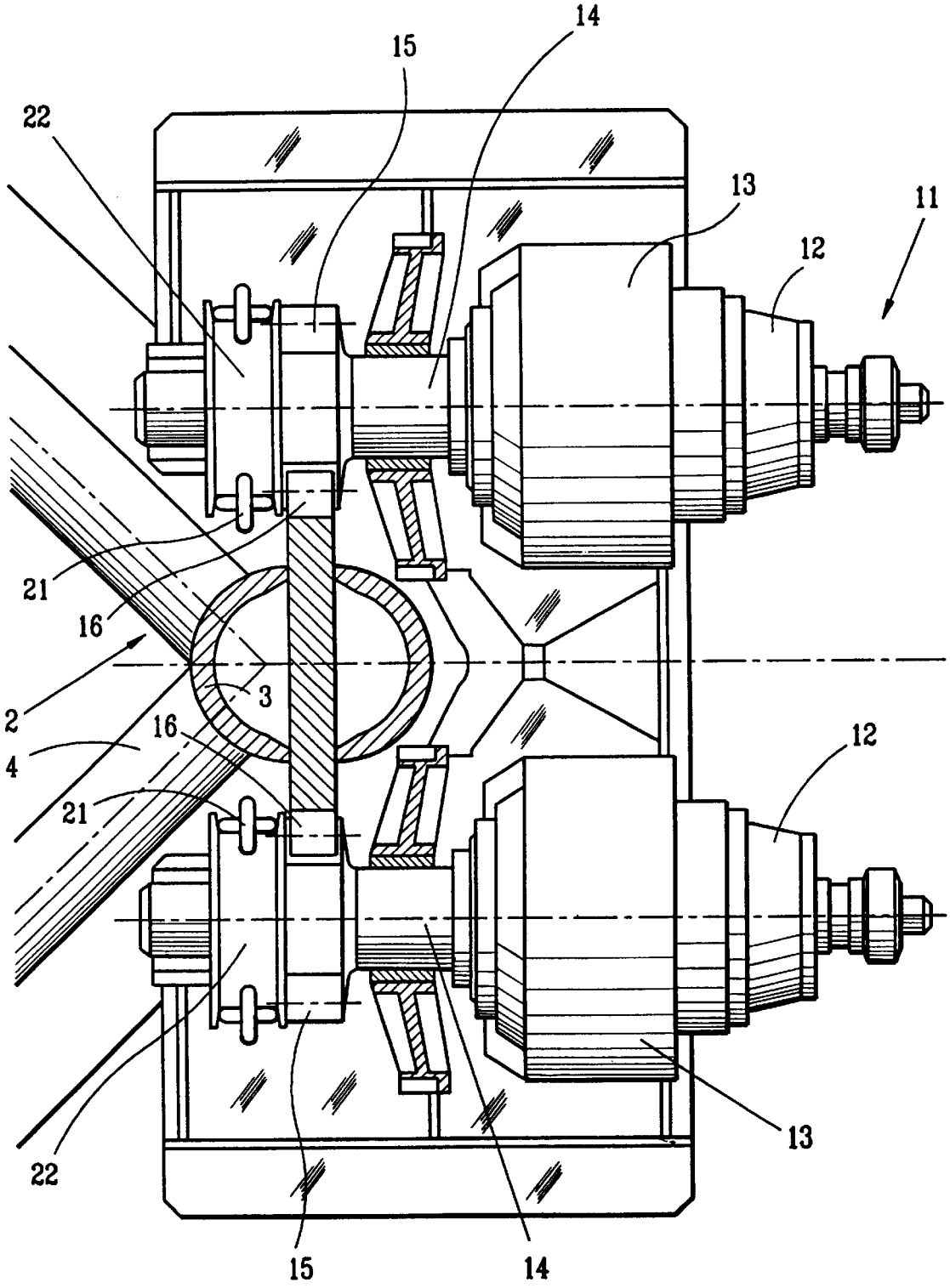
FIG. 6 is a sectional view taken along line 6—6 of FIG. 4.
Figure 7:
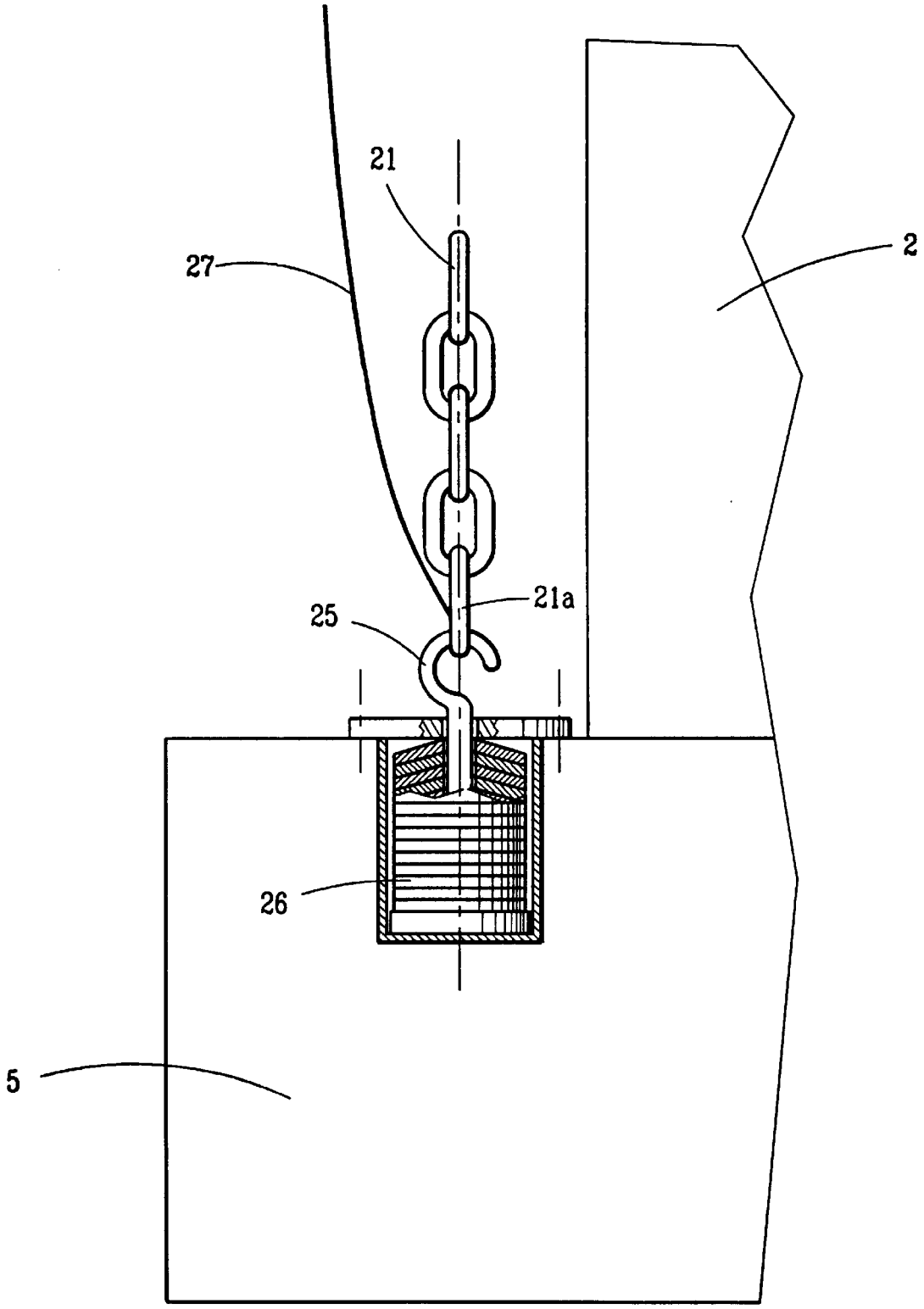
FIG. 7 is a diagrammatic sectional view showing the attachment of a chain to a foot of a leg of the platform according to the invention.

Referring now to FIGS. 4 to 6, a drive mechanism 10 associated with one cord 3 of a leg 2 will be described, the other drive mechanisms being identical.

Each drive mechanism 10 is composed of at least two opposed sets 11, each one formed of a motor 12 associated with a set of reduction gears 13.

In the embodiment represented in the figures, each drive mechanism 10 is composed of three pairs of opposed sets 11 superimposed one above the other, the number of pairs of superimposed sets depending on the mass of the barge 1 to be moved.

The motor 12 and the set of reduction gears 13 of each set 11 drive, via a shaft 14, an output pinion 15 which interacts with a rack 16 provided on the corresponding chord 3.

In this way, each chord 3 of each of the legs 2 includes two opposed racks 16 running along only a given length of the legs 2. The pinion 15 and the racks 16 in the platform according to the invention have the sole purpose of moving the barge 1 between the position for floating (FIG. 1) and the position for production out of the water (FIG. 2).

As a result of this, each rack 16 is arranged at the upper part of the chords 3 of the legs 2, as represented in FIGS. 1 and 2.

The racks 16 run along a height of between 20 and 30% of the total height of the legs 2.

By way of example, for legs 2 which are 132 meters tall, the racks 16 run along a length of 29 meters, which represents approximately 22% of the total height of the legs 2.

To allow the legs 2 to be lowered as far as the bearing structures 6 or as far as the seabed 7, the platform according to the invention is equipped with means 20 for controlling the lowering of each leg 2.

Referring to FIGS. 4 to 6, one means for controlling the lowering of one leg will be described, the other means being identical.

Each leg 2 is equipped with four means for controlling the lowering of the corresponding leg 2 and each means is composed of two chains 21 which interact with a lower set 11 of each drive mechanism 10.

In this way, each leg 2 is associated with eight chains 21 for lowering the corresponding leg.

Each chain 21 has a first end 21*a* linked detachably to the corresponding foot 5 and a second end 21*b* linked to the barge 1.

What is more, each chain 21 interacts with a meshing member 22 mounted on the driveshaft 14 of an output pinion 15.

The length of each chain is sufficient to allow the corresponding leg 2 to be lowered from its raised position as far as its position bearing on the bearing structure 6 or on the seabed 7.

In this way, when each leg is in the raised position as represented in FIG. 1, the surplus of each chain 21 is stored in a pit 23 formed in the barge 1.

Each meshing member 22 interacting with a chain 21 consists, for example, of a sprocket wheel or of a capstan wheel.

The diameter of each meshing member 22 is greater than the diameter of the output pinion 15 which means that the rate at which each chain 21 is paid out is higher than the tangential speed developed by the pinions 15 on the racks 16.

Moreover, the first end 21*a* of each chain 21 is linked to the foot 5 by means of a hook 25 which is itself linked to the foot 5 by an elastic linkage member 26 consisting, for example, of a stack of elastic washers or of any other appropriate device.

The end 21*a* of each chain 21 is therefore removably linked to the corresponding foot 5 and is linked to the barge 1 by a recovery line 27, a first end 27*a* of which is linked to the end 21*a* of the corresponding chain and a second end 27*b* of which is fixed to the drum of a winch 28 allowing the corresponding chain 21 to be raised back up, as will be seen later.

The end 21*a* of each chain 21 may be detached from the hook 25, for example by a robot or by any other appropriate means.

Finally, each foot 5 of the platform constitutes a buoyancy element making it possible to reduce the rate of lowering of the legs 2 and decrease the weight of these legs 2 as they are lowered.

The platform is placed on the bearing structure 6 or on the seabed 7 as follows.

When the platform has been brought to the drilling or production site by floating the barge 1 out, the motors 12 and the reduction gears 13 turn the shafts 14, the pinions 15 and the meshing members 22, and this has the effect of driving the chains 21 and causing the legs 2 to be lowered by the paying out of the chains 21.

The chains 21 progressively run out and the length of these chains is sufficient to lower the legs 2 as far as the bearing structure 6 or as far as the seabed.

Before the feet 5 of the legs 2 come to bear on the bearing structure 6 or on the seabed 7, the racks 16 progressively mesh with the pinions 15 and the weight of the barge 1 is gradually taken up by the pinions 15 as the barge 1 comes out of the water.

While the legs 2 are being lowered, the feet 5 which form buoyancy elements restrain these legs 2, thus reducing the loads applied to the chains 21 and the meshing members 22.

Next, the barge 1 is progressively raised up out of the water using the racks 4 and the pinions 15.

Once the platform is in the production position, that is to say the barge 1 is out of the water, the ends 21*a* of the chains 21 are detached from the legs 5 by any appropriate means and the chains 21 are raised back up onto the barge 1 using the recovery lines 27 and the winches 28.

Limiting the length of the racks 4 along the chords 3 of the legs 2 and positively controlling the lowering of the legs 2 independently of the racks 4 makes it possible to make the legs 2 lighter, reduce the hydrodynamic drag of these legs 2, and reduce the cost of manufacturing the legs 2.

I claim:

1. Jack-up offshore drilling or production oil platform comprising:

a plurality of bearing legs;

a barge movably mounted along said bearing legs so that said barge can be moved between a floating position and a production position out of a body of water;

a plurality of drive mechanisms associated with each of said bearing legs, each of said drive mechanisms including at least a first pair of opposed sets, and each of said sets including a motor operatively associated with at least one set of reduction gears;

an output pinion connected, via a shaft, to each of said sets of reduction gears;

a plurality of pairs of opposed racks associated with said drive mechanisms, respectively, each of said pairs of opposed racks being fixedly mounted on said corresponding bearing leg so as to interact with said corresponding output pinions, wherein said drive mechanisms allow said bearing legs to be moved between a raised position and a position in which said bearing legs engage a bearing structure or a seabed, and each of said racks is provided along a length of said respective bearing leg necessary for moving said barge between the floating position and the production position; and means associated with each of said bearing legs for controlling the lowering of said bearing legs as far as the bearing structure or the seabed, wherein said means for controlling the lowering of each of said bearing legs comprises a meshing member mounted on said shaft of each of said output pinions and at least one chain interacting with each of said meshing members, said chain having a first end and a second end, said first end being linked to a foot of said corresponding bearing leg, said second end being linked to said barge, and the length of said chain being sufficient to allow the corresponding bearing leg to be lowered as far as the bearing structure or the seabed.

2. The platform as claimed in claim 1, wherein a rate at which each of said chains is paid out is higher than a tangential speed developed by said pinions along said racks.

3. The platform as claimed in claim 1, wherein each of said meshing members comprises a sprocket wheel.

4. The platform as claimed in claim 1, wherein each of said meshing members comprises a capstan wheel.

5. The platform as claimed in claim 1, wherein said first end of each chain is linked to said foot of said corresponding bearing leg by an elastic linkage member.

6. The platform as claimed in claim 5, wherein said first end of each of said chains is detachable from said corresponding elastic linkage member.

7. The platform as claimed in claim 1, further comprising a plurality of lines connected to said first ends of said chains, respectively, and each of said lines being connected to said barge for recovering said respective chain.

8. Jack-up offshore drilling or production oil platform comprising:

a plurality of bearing legs;

a barge movably mounted alone said bearing legs so that said barge can be moved between a floating position and a production position out of a body of water;

a plurality of drive mechanisms associated with each of said bearing legs, each of said drive mechanisms including at least a first pair of opposed sets, and each of said sets including a motor operatively associated with at least one set of reduction gears;

an output pinion connected, via a shaft, to each of said sets of reduction gears;

a plurality of pairs of opposed racks associated with said drive mechanisms, respectively, each of said pairs of opposed racks being fixedly mounted on said corresponding bearing leg so as to interact with said corresponding output pinions, wherein said drive mechanisms allow said bearing legs to be moved between a raised position and a position in which said bearing legs engage a bearing structure or a seabed, and each of said racks is provided along a length of said respective bearing leg necessary for moving said barge between the floating position and the production position; and means associated with each of said bearing legs for controlling the lowering of said bearing legs as far as the bearing structure or the seabed, wherein said means for controlling the lowering of each of said bearing legs comprises a meshing member mounted on said shaft of each of said output pinions, and at least two chains interacting with each of said meshing members, each of said two chains having a first end and a second end, said first ends being linked to a foot of said corresponding bearing leg and said second ends being linked to said barge, and the length of each of said two chains being sufficient to allow said corresponding bearing leg to be lowered as far as the bearing structure or the seabed.

9. The platform as claimed in claim 8, wherein a rate at which each of said two chains is paid out is higher than a tangential speed developed by said pinions along said racks.

10. The platform as claimed in claim 8, wherein each of said meshing members comprises a sprocket wheel.

11. The platform as claimed in claim 8, wherein each of said meshing members comprises a capstan wheel.

12. The platform as claimed in claim 8, wherein said first end of each of said two chains is linked to said foot of said corresponding bearing leg by an elastic linkage member.

13. The platform as claimed in claim 12, wherein said first end of each of said two chains is detachable from said elastic linkage member.

14. The platform as claimed in claim 8, further comprising a plurality of lines connected to said first ends said chains, respectively, and each of said lines being connected to said barge for recovering said respective chain.

* * * * *